US009618264B1

(12) United States Patent
Berdut-Teruel

(10) Patent No.: US 9,618,264 B1
(45) Date of Patent: Apr. 11, 2017

(54) PERMANENT MAGNET INDUCTION HEATING SYSTEM AND MAGNETIC DEHYDRATOR

(71) Applicant: Elberto Berdut-Teruel, San Juan, PR (US)

(72) Inventor: Elberto Berdut-Teruel, San Juan, PR (US)

( * ) Notice: Subject to any disclaimer, the term of this patent is extended or adjusted under 35 U.S.C. 154(b) by 340 days.

(21) Appl. No.: 14/522,638

(22) Filed: Oct. 24, 2014

Related U.S. Application Data

(63) Continuation-in-part of application No. 12/878,117, filed on Sep. 9, 2010, now Pat. No. 8,866,053, and a continuation of application No. 13/488,573, filed on Jun. 5, 2012, now abandoned.

(51) Int. Cl.
*H05B 6/36* (2006.01)
*F26B 19/00* (2006.01)
*F26B 23/04* (2006.01)
*F26B 11/02* (2006.01)

(52) U.S. Cl.
CPC ..... *F26B 23/04* (2013.01); *F26B 11/028* (2013.01)

(58) Field of Classification Search
CPC ..... F26B 23/04; F26B 11/028
USPC ..... 219/10.51, 10.65, 10.491, 601–602, 607, 219/627–632, 635, 643–644, 658, 219/670–672, 677, 648–649, 652; 34/218, 443
See application file for complete search history.

*Primary Examiner* — Ket D Dang
(74) *Attorney, Agent, or Firm* — Luis Figarella

(57) ABSTRACT

A device and method for dehydrating products, through gasifying the humidity in the air or on any wet element through the application of air, heat and magnetic fields. Such a process would be useful for the drying of clothing, grain, food and other industrial uses. In a separate implementation, measure addition of moisture to the air or gas in the system could be used to generate hydrogen and/or oxygen via a gas separator, such as the membrane units in use today. The magnetic fields used may be built using electromagnetic and/or permanent magnets.

3 Claims, 13 Drawing Sheets

PERMANENT MAGNET INDUCTION HEATING SYSTEM AND MAGNETIC DEHYDRATOR

CROSS-REFERENCE TO RELATED APPLICATIONS

This application is a continuation-in-part of pending U.S. Appl. "Permanent Magnet Induction Heating", Ser. No. 12/878,117 and of U.S. Appl. "Magnetic Dehydrator", Ser. No. 13/488,573, the disclosure of both being incorporated herein by reference in its entirety.

PATENTS CITED

The following documents and references are incorporated by reference in their entirety, Berdut-Teruel (US Pat. Pub. No. 2011/0272398) and Berdut-Teruel (US Pat. Pub. No. 2011/0272399), Kongmark et al (U.S. Pat. No. 7,935,254), Noda (European Patent Appl. EP2147897), Coffman (U.S. Pat. No. 5,036,602), Clawson (U.S. Pat. No. 4,665,628), Botkins et al (U.S. Pat. No. 4,263,722), Lee et al (2004/0050801), Skeist et al (U.S. Pat. No. 6,984,897), Gerard et al (U.S. Pat. No. 5,012,060) and Mohr (U.S. Pat. No. 4,671,527).

FIELD OF THE INVENTION

The present invention generally relates to inducing heat and levitation onto surfaces with metallic components from permanent magnets in various configurations, including a device and method for gasifying the humidity in the air or on any wet element through the application of air, heat and magnetic fields. Such a process would be useful for the drying of clothing, grain, food and other industrial uses. In a separate implementation, measure addition of moisture to the air or gas in the system could be used to generate hydrogen and/or oxygen via a gas separator, such as the membrane units in use today. The magnetic fields used may be built using electromagnetic and/or permanent magnets. In addition, the present invention generally relates to the gasification of moisture within a gas by the separation of the water molecules present in it into their separate hydrogen and oxygen components through their gasification when heated and subjected to a magnetic field generated via electromagnetic or permanent magnet mechanisms.

DESCRIPTION OF THE RELATED ART

Many processes today use fossil fuels (either directly or through the use of electricity generated using said fossil fuels). For example, clothe driers, water heaters, space heaters and other applications such as these are routinely performed using thermic heat generated either via electric radiance, or through the burning of gases such as Propane.

The induction of heat via electric current created electromagnetic fields is well understood and has been selected by many designers in order to tightly control the application of the heat (via the intensity of the magnetic field). However, in many cases, permanent magnet thermal generators are not used. This results in the burning of additional resources in order to generate the heat for the process.

A number of permanent magnet thermal generators have been suggested in the past. Skeist et al (U.S. Pat. No. 6,984,897), Gerard et al (U.S. Pat. No. 5,012,060) and Mohr (U.S. Pat. No. 4,671,527), among others, suggest the use of permanent magnets and a heat transfer fluid.

Most of these produce the heat, but often at the cost of additional complexity. In most cases, these permanent magnet thermal generators have the undesired effects of putting rotating stresses on the magnets and dispersing the thermal energy among others.

Drying of items is usually accomplished through the use of heat, which facilitates the evaporation of humidity. In many applications, particularly when dealing with foodstuff (i.e. Coffee and Cocoa beans) as well as with delicate items of clothing, a tradeoff must be reached, wherein too high a temperature (which would facilitate drying) would damage the item being dried. Similar limitations exist when drying fruit. This results in significantly longer drying times. In addition, Hydrogen and Oxygen are traditionally generated via electrolysis, in which the passage of a direct current through an ionic substance that is either molten of dissolved in a suitable solvent results in a chemical reaction at the electrodes and the separation of materials. By encasing the electrodes in separate chambers, the gases are maintained separated. Unfortunately, this process is energy intensive. Over 90% of the hydrogen currently generated across the globe is made using natural gas found in fossils fuels, which of course has all the disadvantages associated with a large carbon footprint.

There is a need in the art for a system and method to facilitate the drying of items while at the same time generating hydrogen and/or oxygen, one in particular that would have a small carbon footprint while also using renewable resources by using magnetic heat generation.

SUMMARY OF THE INVENTION

This section is for the purpose of summarizing some aspects of the present invention and to briefly introduce some preferred embodiments. Simplifications or omissions may be made to avoid obscuring the purpose of the section. Such simplifications or omissions are not intended to limit the scope of the present invention.

In one aspect the invention is about a product dehydrator system comprising a series of conduits connecting one or more chambers, one or more said chambers containing gas heating means, one or more said chambers containing gas moving means, one or more said chambers containing product drying means, wherein said product drying means are comprised of a drying tumbler assembly comprised of solid wall insulated housing having within it a rotating tumbler made from a mesh material and having porous walls, said rotating tumbler having one or more angled blades having a scoop shape that avoids right angles at any point, each blade having a curved blended base with no sharp angles at the juncture of said blade to said rotating tumbler, forming a constant radius curve shaped base on both sides of said blade base so that each said blade lifts and drops portions of the product within to create a product cascade past an airflow stream going horizontally from an entry opening located on the side of said housing to an exit opening located on the opposite side in said tumbler assembly's solid walls, both said openings being connected to portions of the series of conduits, said solid walls also having one or more venting openings at its top, for venting of portions of said airflow out of the series of conduits and into the atmosphere, said gas heating means are provided by the operation of a permanent magnet thermal generator apparatus comprising a magnetic cylinder rotatable about its concentric longitudinal axis whose magnetic surface is made of alternating N-pol and S-pol permanent magnets, said magnetic cylinder magnetic surface has phenolic material interspersed between said N-pol and said S-pol permanent magnets, one or more hollow orbital pipes, each said orbital pipe freely rotatable about its own concentric axis of rotation, wherein said axis of rotation is parallel to and offset from the longitudinal axis of said magnetic cylinder, each said orbital pipe having at least one metal portion directly exposable to a magnetic field to be generated by said N-pol and S-pol permanent magnets mounted within said magnetic cylinder when said magnetic cylinder is rotated so that any rotation of each said orbital pipe is due solely to the effect of the magnetic field induced on said orbital pipe by said magnetic cylinder rotation, a mechanism for rotating said magnetic cylinder around its longitudinal axis, and said magnetic cylinder when so rotated induces independent rotation of each said one or more hollow pipes about its respective offset concentric longitudinal axis and said gas moving means are comprised of a fan. In another aspect, the system further comprises hydrogen separation means.

In another aspect, the product dehydrator system comprises a series of conduits connecting one or more chambers, one or more said chambers containing gas heating means, one or more said chambers containing gas moving means, one or more said chambers containing product drying means, wherein said product drying means are comprised of a drying tumbler assembly comprised of solid wall insulated housing having within it a rotating tumbler made from a mesh material and having porous walls, said rotating tumbler having one or more angled blades having a scoop shape that avoids right angles at any point, each blade base having a curved blended base with no sharp angles at the juncture of said blade to said rotating tumbler, forming a constant radius curve shaped base on both sides of said blade base so that each said blade lifts and drops portions of the product within to create a product cascade past an airflow stream going horizontally from an entry opening located on the side of said housing to an exit opening located on the opposite side in said tumbler assembly's solid walls, both said openings being connected to portions of the series of conduits, said solid walls also having one or more venting openings at its top, for venting of portions of said airflow out of the series of conduits and into the atmosphere, said gas heating means are provided by the operation of a permanent magnet thermal generator apparatus comprising a hollow magnetic cylinder rotatable about its concentric longitudinal axis whose magnetic surface is made of alternating N-pol and S-pol permanent magnets, said magnetic cylinder magnetic surface has phenolic material interspersed between said N-pol and said S-pol permanent magnets, one or more hollow orbital pipes located inside said hollow magnetic cylinder and having at least one metal portion directly exposable to a magnetic field to be generated by said N-pol and S-pol permanent magnets mounted on said hollow magnetic cylinder when said hollow magnetic cylinder is rotated, each said hollow orbital pipes is freely rotatable about its concentric axis of rotation, wherein said axis of rotation is parallel to and offset from the longitudinal axis of said magnetic cylinder, and located inside the inner surface of said hollow magnetic cylinder so that any rotation of each said orbital pipe is due solely to the effect of the magnetic field induced on said orbital pipe by said magnetic cylinder rotation, a mechanism for rotating said magnetic cylinder around said magnetic cylinder's longitudinal axis and said magnetic cylinder when so rotated induces independent rotation of each said one or more hollow orbital pipes about its respective offset concentric longitudinal axis and said gas moving means are comprised of a fan.

In one aspect, the invention is about a product dehydrator method comprising providing a series of conduits and connecting with them one or more chambers, providing one said chamber containing a magnetic field generator, providing one said chamber containing gas heating means, providing one said chamber containing gas moving means, providing one said chamber containing product drying means and filing the product drying means with no more than 66 percent of the volume of the tumbler with a product and operating the system. In another aspect, said method comprises a magnetic field generator comprised of a permanent magnet magnetic tunnel, said gas heating means are comprised of a heating chamber and said gas moving means are comprised of a fan. In yet another aspect, said permanent magnet magnetic field generator is comprised of a magnetic cylinder rotating around the longitudinal axis defined by a line linking the centers of said cylinder bases, said magnetic cylinder having one or more permanent magnets with a North polarity mounted at or near the surface of said magnetic cylinder, as well as one or more permanent magnets with a South polarity mounted at or near the surface of said magnetic cylinder, one or more elongated heating elements, each said elongated heating element rotating along said heating element's individual longitudinal axis, each said elongated heating element's longitudinal axis being parallel and offset from the longitudinal axis of said magnetic cylinder, and each said elongated heating element having at least one metal portion placed within the magnetic field generated by either the north or south polarity magnets mounted within said magnetic cylinder, plus a mechanism for rotating said magnetic cylinder around its longitudinal axis, said gas heating means are comprised of a heating chamber and said gas moving means are comprised of a fan.

Other features and advantages of the present invention will become apparent upon examining the following detailed description of an embodiment thereof, taken in conjunction with the attached drawings.

Figure 1:
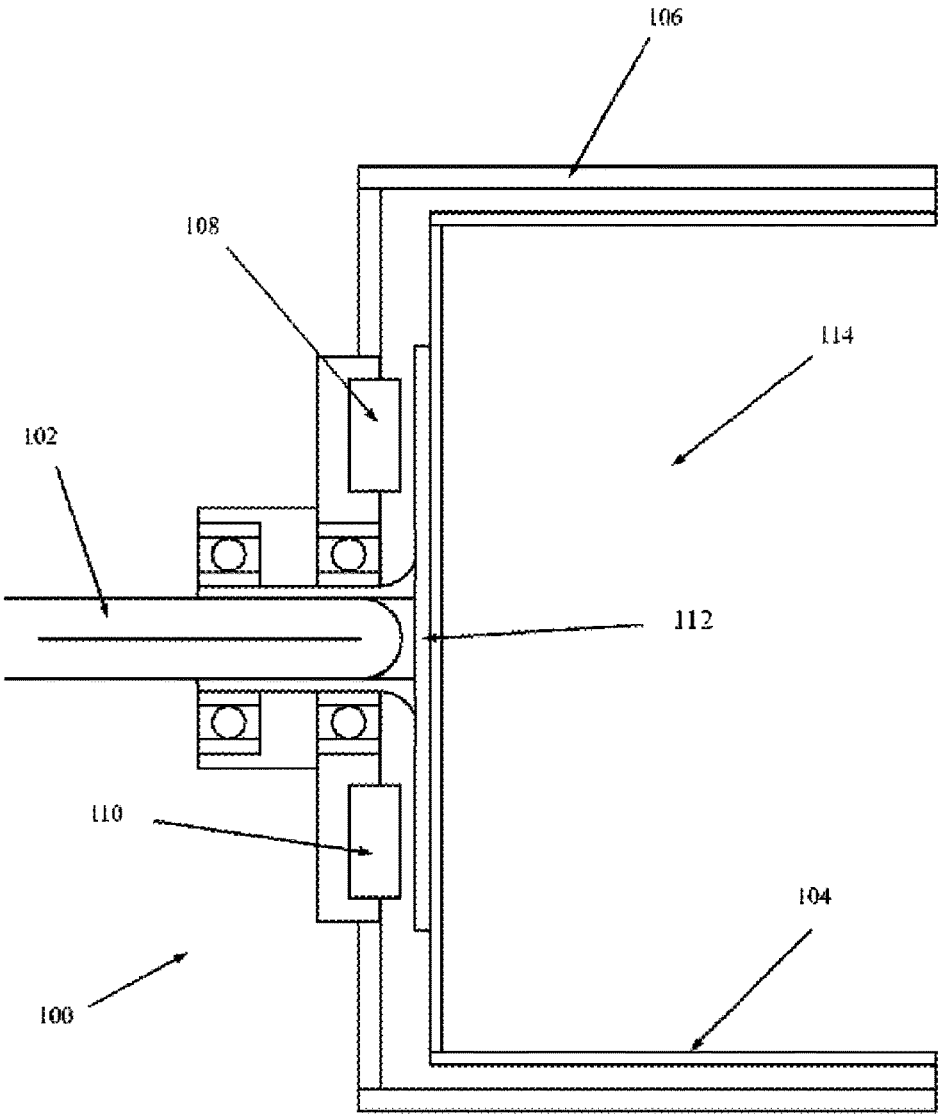
FIG. 1 shows an illustration of a heating chamber according to an exemplary embodiment of the invention.

The above-described and other features will be appreciated and understood by those skilled in the art from the following detailed description, drawings, and appended claims.

DETAILED DESCRIPTION OF THE PREFERRED EMBODIMENT

To provide an overall understanding of the invention, certain illustrative embodiments and examples will now be described. However, it will be understood by one of ordinary skill in the art that the same or equivalent functions and sequences may be accomplished by different embodiments that are also intended to be encompassed within the spirit and scope of the disclosure. The compositions, apparatuses, systems and/or methods described herein may be adapted and modified as is appropriate for the application being addressed and that those described herein may be employed in other suitable applications, and that such other additions and modifications will not depart from the scope hereof.

Simplifications or omissions may be made to avoid obscuring the purpose of the section. Such simplifications or omissions are not intended to limit the scope of the present invention. All references, including any patents or patent applications cited in this specification are hereby incorporated by reference. No admission is made that any reference constitutes prior art. The discussion of the references states what their authors assert, and the applicants reserve the right to challenge the accuracy and pertinence of the cited documents. It will be clearly understood that, although a number of prior art publications are referred to herein, this reference does not constitute an admission that any of these documents form part of the common general knowledge in the art.

As used in the specification and claims, the singular forms "a", "an" and "the" include plural references unless the context clearly dictates otherwise. For example, the term "a transaction" may include a plurality of transaction unless the context clearly dictates otherwise. As used in the specification and claims, singular names or types referenced include variations within the family of said name unless the context clearly dictates otherwise.

Certain terminology is used in the following description for convenience only and is not limiting. The words "lower," "upper," "bottom," "top," "front," "back," "left," "right" and "sides" designate directions in the drawings to which reference is made, but are not limiting with respect to the orientation in which the modules or any assembly of them may be used.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

FIG. 1 illustrates one exemplary embodiment of the invention 100, a rotating chamber 114 created by the rotation of the chamber's inner cavity 104 around a fixed (non-rotating) outer chamber 106. In one embodiment, the chamber's rotation is created by the rotation of a central shaft 102. Said shaft may be powered by a number of sources, including human, animal, wind or water via direct, belt or other means. Similarly, the rotation may be created by the use of pneumatic, hydraulic, electric (including both AC and DC models), internal combustion or other kinds of motors. In addition, in one embodiment, the motion may be created by the rotation of one chamber versus the other, as would be case if the two chambers were simply pulled via an axis along a trail.

Figure 2:
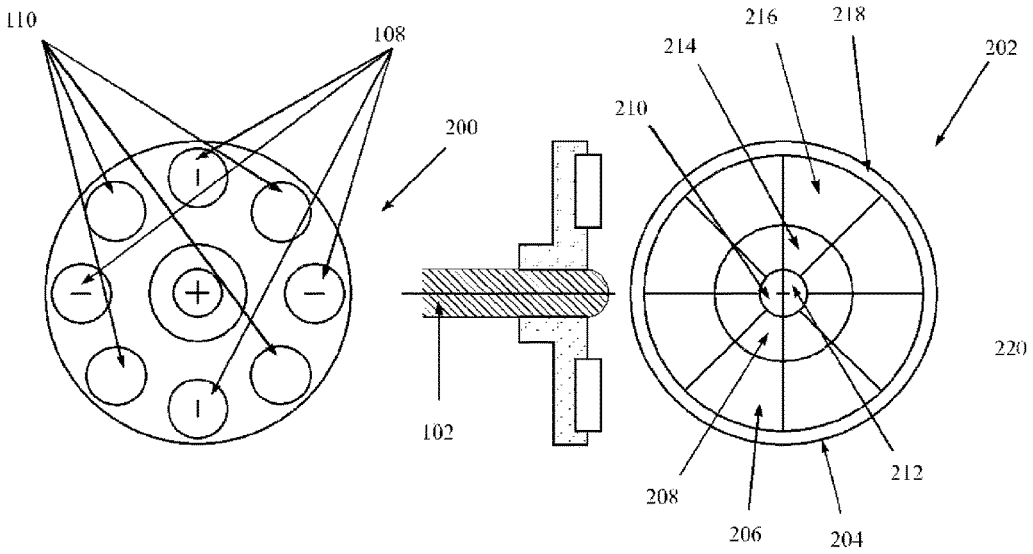
FIGS. 2 and 3 show illustrations of heating devices according to exemplary embodiments of the invention.

The rotary motion of one chamber relative to the other is required in order to induce a varying magnetic field (created by exposure to successive alternating North-South polarity magnets) on one or more heating elements, in one embodiment formed by one or more heat plates 112. This magnetic field flux causes the heat plates 112 to get warm, as a reflection of how fast it is changed. As seen in FIG. 2, there are many embodiments possible in placing the magnets on the magnet holder plate 116 (discussed below). Many previous implementations have used rotating magnet holder plates, but in one embodiment, the present invention allows them to remain fixed, and rotation of the material chamber provides the advantage of a direct-link, one (or less) motor solution.

The heating element, whether a heat plate 112 or a hoop 302, may be comprised of any combination of metal, metal coated surface or embedded metal (within the structure) including alone or in combination (or composite) of ferrous or magnetic metals (those comprised of metals with magnetic properties, including but not limited to iron, steel, etc.) as well as non-ferrous or non-magnetic metals (including but not limited to copper, aluminum, etc.). In one embodiment, the complete rotating assembly 104 is made of metal, in order to conduct the heat generated at the heat plate 112 throughout the walls of the rotating chamber 114. In an alternate embodiment, only the heat plate 112 is made of metal, with the balance of the rotating assembly made of plastic, wood or such other low cost material. In an alternate embodiment, metallic rods are embedded on a ceramic envelope (such as with a pizza stone where the heat is induced by the rotation of the magnetic surface).

To prevent the accidental burning of the material inside the heating chamber 114, in one embodiment a grill or other fluid-allowing element is placed over the portions of the heat plate 112 coming in contact with the material, and vanes are placed inside the rotating chamber 104 surfaces to facilitate the "tumbling" of the materials within the chamber 114. In one embodiment, air input/exhaust means are created by placing openings along the walls of the rotating chamber 104, and vanes in connection to input/output valves to facilitate the creating of an exhaust stream of the humid heated air. One embodiment of this would be to create a chimney effect by placing an exit opening on the top of the outer chamber 106, and an opening at the bottom (with or without valves). In an alternate embodiment, a fan powered from the rotation of the shaft 102 could be added. In one embodiment, the vanes placed within the rotating chamber 104 would also do it. In an alternate embodiment, vanes placed between the rotating 104 and fixed 106 chambers could also do it.

Figure 5:
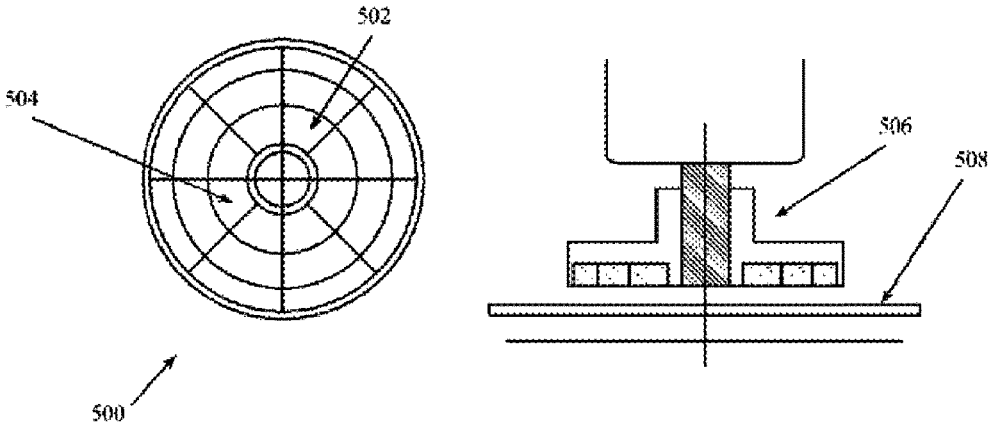
FIG. 5 shows an illustration of a heating or levitation device according to an exemplary embodiment of the invention.

In one embodiment, the magnet holder plate 116 has one or more pairs of North polarity (N-pol 108) and South polarity (S-pol 110) permanent magnets placed around a single non-rotating flat disk. These N-pol, S-pol pairs of magnets may be circular 200 in shape, triangular, or any other geometrical combination thereof. In one embodiment, pairs of permanent magnets may be used, so that one particular radial axis of the wheel contains a S-N-S polarity (or N-S-N) at the opposite end. In that case, the area of the magnets need not be similar, but would be optimal as long as the area of their opposite pole is significantly similar. (204 to 218), (206 to 216), (208 to 214) and (210 to 212). Similarly, as seen in FIG. 5, the same can be done with the segments, as long as the paired opposite magnet sections (502 to 504). In an alternate embodiment, the number of N-S magnets need not match.

Note that in defining North or South polarity on a permanent magnet, we are using the "North" pole of a magnet as defined by the National Bureau of Standards (NBS) convention. Said convention is based on the following: "The North Pole of a magnet is that pole which is attracted to the geographic North Pole. Therefore, the North Pole of a magnet will repel the north seeking pole of a magnetic compass." Its significant opposite is the South Polarity.

As the inner cavity 104 rotates, the attached heat plate 112 also rotates, and the magnetic field of each permanent magnet will induce an oscillating magnetic field over the heat plate 112 as the polarity of this induced magnetic field is sequentially reversed, inducing a temperature increase on the heat plate 112 as well as on any other metallic surface portion of the rotating inner cavity 104 subjected to the magnetic field flux.

Figure 3:
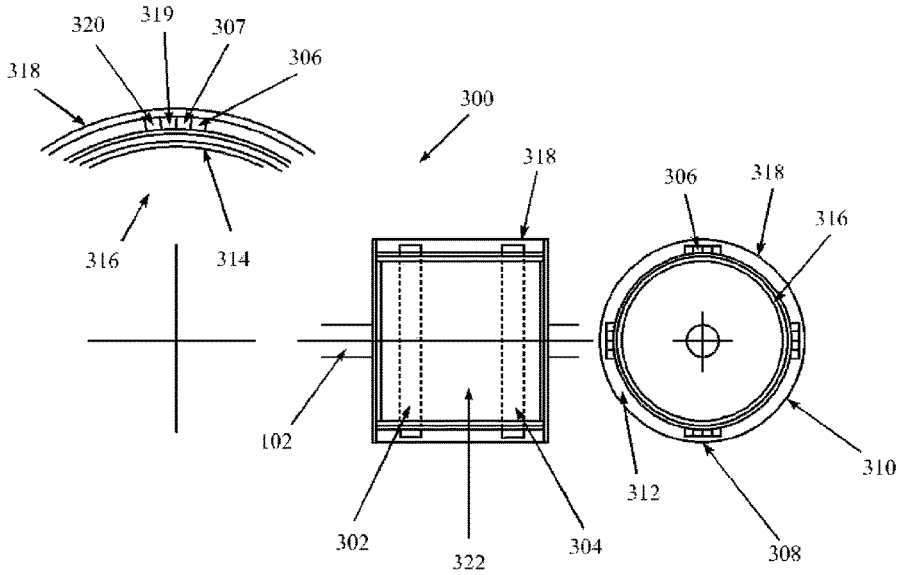

In another exemplary embodiment, illustratively shown in FIG. 3 the magnetic flux variation is induced on a heating element comprised of one or more metallic hoops (302, 304) or sections of hoops placed around the waist of a rotating cylindrical structure 316 placed within a non-rotating chassis 318. The rotating portion 316 is turned by a shaft 102. Notice said hoops need not be continuous as shown in FIG. 3, and may be constructed of dis-connected segments, as long as one or more of said segments cross the alternating magnetic fields (N-S) of the magnets. These hoops function as heat plates when they linearly move through a series of magnets of N-S orientation (306 N, 307 S, 319 N, 320 S) that are placed around the periphery, in close proximity to the hoops (302, 304).

As the hoops pass during the rotation of the inner rotating structure 316, the magnetic flux transition will cause the temperature of the hoops (302, 304) to increase, in turn raising the temperature of the internal structure 316 and the temperature of the cavity 322. Such an arrangement would make the assembly a natural furnace with which to warm any fluids going through it. Some potential fluids in use include Oil, Air, Water, Sodium and others.

Figure 4:
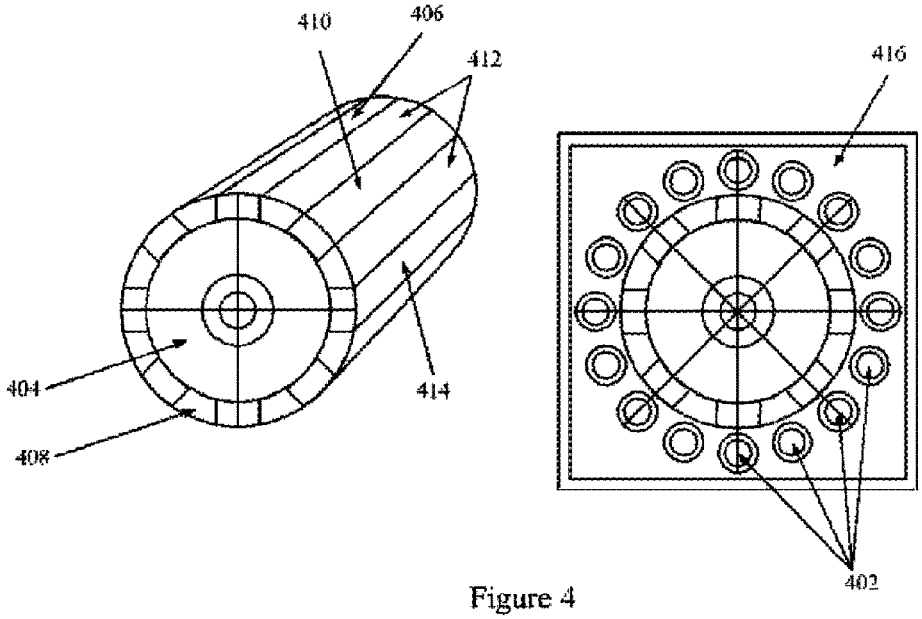
FIG. 4 shows an illustration of a fluid heating device according to an exemplary embodiment of the invention.

In another exemplary embodiment, illustrated in FIG. 4, a fluid heater 400 is illustrated. In it, tubes or pipes 402 surround a rotating permanent magnet assembly cylinder 404, whose magnetic surfaces are made of alternating N-pol (406, 414, etc.), S-Pol (408, 410, etc.) permanent magnets and optionally interposed phenolic 412 or other magnetic neutral materials. Said phenolic material may be used in other embodiments, as a way to save on magnetic material yet build appropriate structures. In order to preserve the energy generated, insulating material 416 fills the voids.

In one embodiment, the pipes are metal, or metal lined (be they ferrous or non-ferrous metals). In an alternate embodiment, the tubes are made of a non-metallic material (for example PVC), but contain either an internal metallic lining, an internal hollow tube of lesser diameter made of metal, or simply a solid metal rod. In an alternate embodiment, the metal rod within the non-metallic tube is itself encased in a plastic shell or sheathing, to minimize interaction with the fluid travelling within it. The magnetic flux hears the metallic portion, which proceeds to heat the fluid within (be it water, air or oil).

Figure 6:
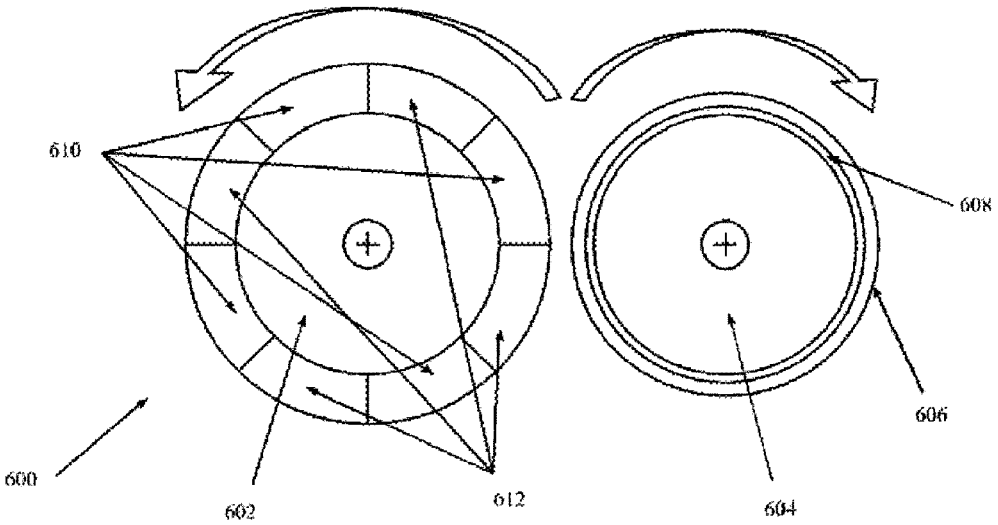
FIGS. 6-9 show illustrations of fluid heating devices, according to exemplary embodiments of the invention.

In another exemplary embodiment, illustrated in FIG. 6, a rotating induction heater 600 is shown. A permanent magnet first cylinder 602 containing a series of alternating permanent magnets on its periphery (N-pol 610, S-pol 612) is rotated (counterclockwise direction is shown, but either direction may be used) to accomplish the desired magnetic flux variation. In an alternate embodiment, phenolic material may be interspersed with between the N-pol, S-pol magnets.

A second cylinder 604 made of a combination ferrous 608 and non-ferrous 606 materials is located in a significant parallel arrangement to the first cylinder. In one embodiment, the inner layer of the cylinder is made of ferrous materials, and the outer layer or skin is made of non-ferrous materials. In an alternate embodiment, the order is reversed, with the non-ferrous material being on the outside. In another embodiment, outer layer is made of a non-metallic material, such as plastic or carbon fiber. In an alternate embodiment, one or more second cylinders surround the first cylinder, all receiving induced heat from the rotating magnetic flux.

In one embodiment, the second cylinder is made to rotate in the opposite direction (Clockwise (CK) if the first is going Counter-Clockwise (CCK), CCK if the first is going (CK)). In yet another embodiment, they are going in the same direction (CK to CK, CCK to CCK). Rotation of the cylinders may come from the same mechanical means (motor, gears, etc.), or from separate means. In one embodiment, one of the cylinders may be made to rotate, and the contact between the first and second cylinder used to rotate the second.

As before, the magnetic flux change induced on the second cylinder generates heat. In one embodiment, the heat is removed by a fluid (liquid or gas) flowing through the inside of the second cylinder. In an alternate embodiment, the complete assembly is submerged in the fluid, and the heat generated is communicated to the surrounding fluid.

In another exemplary embodiment, illustrated in FIG. 5, an induction heater 500 can be seen. In it, a rotating permanent magnet surface 506, similar in construction to the ones embodied above (N-pol 502, S-Pol 504, etc.), proceed to generate a varying magnetic flux on the metallic surface 508. In one embodiment the surface 508 is ferrous, in another non-ferrous. In an alternate embodiment, the surface is non-metallic, with metallic members embedded in them.

As an interesting side effect, the induction of the magnetic flux from the rotating surface on a non-ferrous surface (or a non-metallic surface with non-ferrous elements embedded in it) causes an opposite but equal force orthogonal to the rotation of the surface, in effect causing a levitation force that pushes the surfaces apart with a force proportional to the rotation of the disk.

With such a force, a minimal friction vehicle could be designed to travel over metal or metal covered rails. In an alternate embodiment, the rail is placed on the vehicle, and a collection of rotating surfaces is laid on the roadway at an appropriate distance, rotating only at the time the vehicle is above.

In one embodiment, the motor means and magnet surface are embedded within a cooking surface, and the heating plate is formed as the bottom of a cooking pot or pan. Rotation of the motor will induce heat upon the bottom of the cooking pot.

As before, in one embodiment the magnetic field is built linearly (as a succession of N-pol, S-pol permanent magnets with or without any phenolic material between them), that moves along an axis, and significantly parallel to a non-ferrous metal surface laid along a railway or roadway (or portions of a surface, or portions of a rail). As the vehicle reaches a critical speed, it the magnetic flux would generate sufficient "lift" (really opposite force) to both reduce its effective load on the load bearing wheels, or even eliminate it and travel "airborne". In an alternate embodiment, the metal/composite rail would be on the vehicle, and the magnets would be on the roadway.

The above would provide significant efficiencies to a Metro system (trains at speed would get "free" lift), as well as potentially create an assist to the Catapult launching of aircraft, as the speed of the vehicle would provide significant lift (and they are made mainly of aluminum).

Figure 7:
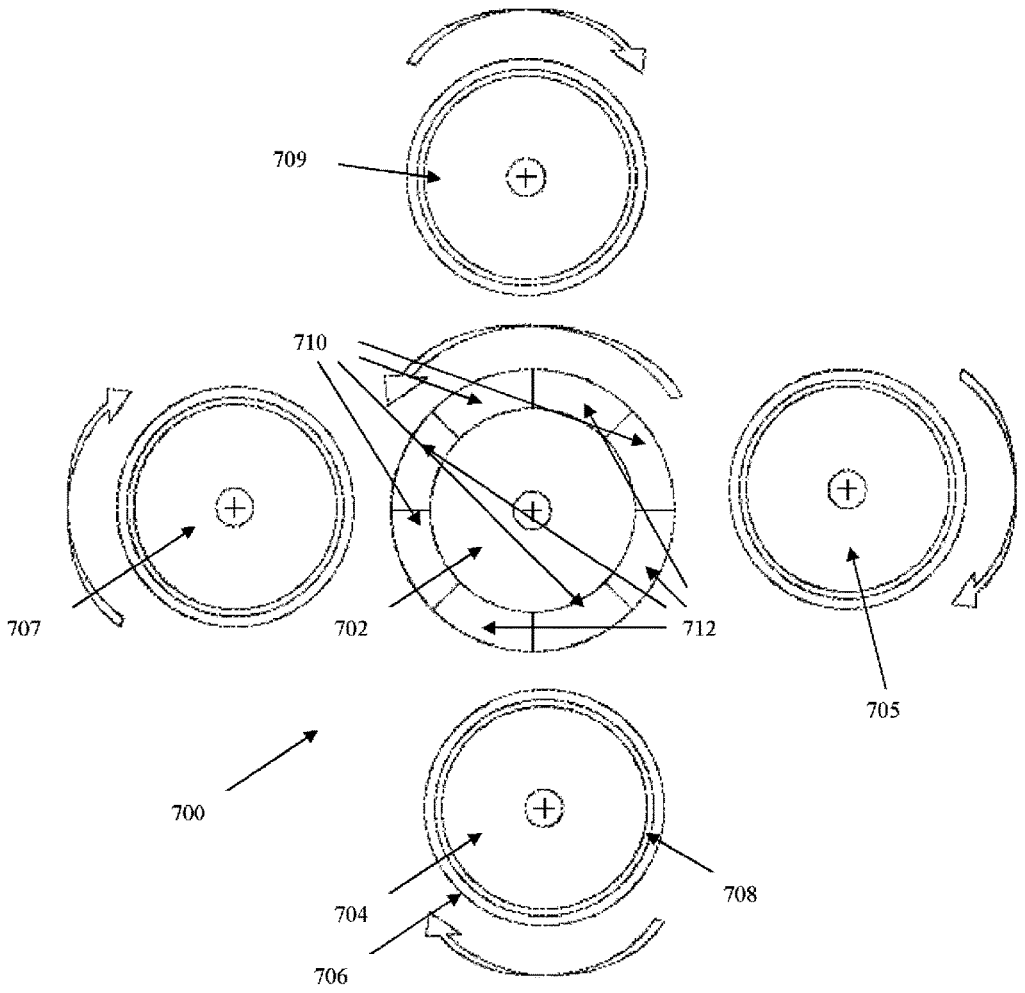

In an alternate embodiment, exemplary illustrated in FIG. 7 a rotating induction heater assembly 700 is shown. A permanent magnet inner cylinder 702 containing a series of alternating permanent magnets on its periphery (N-pol 710, S-pol 712) is rotated (counterclockwise direction is shown, but either direction may be used) to accomplish the desired magnetic flux variation. In an alternate embodiment, phenolic, plastic or non-ferrous material may be interspersed with between the N-pol, S-pol magnets.

One or more orbital cylinders 704, 705, 707, 709 made of a combination ferrous 708 and non-ferrous 706 materials is located in a significant parallel arrangement to the first cylinder. In one embodiment (704), the inner layer of the cylinder is made of ferrous materials 708, and the outer layer or skin is made of non-ferrous materials 706. In one embodiment, all cylinders are made like this. In an alternate embodiment, the order is reversed, with the non-ferrous material being on the outside.

In one embodiment, all the orbital cylinders are made this way. In an alternate embodiment, the orbital cylinders are paired, so that antipode cylinders are made of similar materials (704 with 709, 705 with 707), but not all pairs are identical in makeup. In this way, a system having a central or inner cylinder rotating at a constant speed, may induce different temperatures in the fluids contained within the various pairs of orbital or outer cylinders.

In one embodiment, the orbital cylinders are made to rotate in the opposite direction (Clockwise (CK) if the first is going Counter-Clockwise (CCK), CCK if the first is going (CK)). In yet another embodiment, they are going in the same direction as the inner or central cylinder (CK to CK, CCK to CCK). Rotation of the inner and orbital cylinders may come from the same mechanical means (motor, gears, etc.), or from separate means. In one embodiment, one or more of the orbital cylinders may be made to rotate, and the contact between either the central or even one or more of the orbital cylinders is used to rotate it.

As before, the magnetic flux change induced on one or more of the orbital cylinders generates heat. In one embodiment, the heat is removed by a fluid (liquid or gas) flowing through the inside of the orbital second cylinders. In an alternate embodiment, the complete assembly is submerged in the fluid, and the heat generated is communicated to the surrounding fluid.

Figure 8:
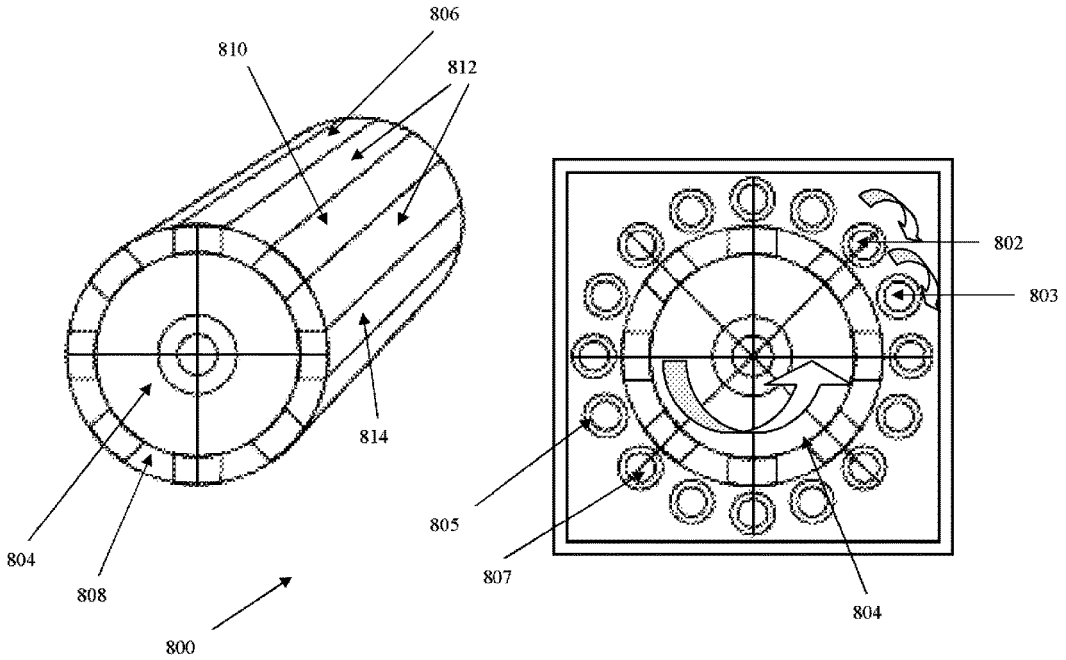

In a similar multi-orbiting cylinder embodiment, seen in an illustrative exemplary embodiment in FIG. 8, a fluid heater 800 is illustrated. In it, orbital tubes or pipes (802, 803, 805, 807 and others) rotate themselves and surround a rotating permanent magnet assembly cylinder 804, whose magnetic surfaces are made of alternating N-pol (806, 814, etc.), S-Pol (808, 810, etc.) permanent magnets and optionally interposed phenolic 812 or other magnetic neutral materials. Said phenolic material may be used in other embodiments, as a way to save on magnetic material yet build appropriate structures. In order to preserve the energy generated, insulating material 816 fills the voids.

In one embodiment, the orbital pipes (802, 803, 805, 807 and others) are metal, or metal lined (be they ferrous or non-ferrous metals). In one embodiment, as with the exemplary embodiment shown in FIG. 7, the outside of the orbital tube is comprised of a ferrous metal, while the inside is lined of a non-ferrous metal. In an alternate embodiment, it is the reverse, with the non-ferrous material being on the outside. The non-ferrous material may be a metal like aluminum or copper, or it may also be a phenolic material like polymers (plastics), wood, or others.

In an alternate embodiment, the orbital pipes are made of a non-metallic material (for example PVC), but contain either an internal metallic lining, an internal hollow tube of lesser diameter made of metal, or simply a solid metal rod. In an alternate embodiment, the metal rod within the non-metallic tube is itself encased in a plastic shell or sheathing, to minimize interaction with the fluid travelling within it. The magnetic flux hears the metallic portion, which proceeds to heat the fluid within (be it water, air or oil).

As in FIG. 7, the orbital pipes or tubes in FIG. 8 may be designed so that one or more of them rotate along a central orbital axis. This allows for a reduction in magnetic field losses (and hence higher system efficiency). The orbital tube rotation may be mechanically induced (through friction with the internal rotating cylinder 804), or through other mechanical means such as belts connected to other motors, or the motor generating the rotation of the central cylinder 804.

They may also be antipodally paired (cylinder 802 with its diametrically opposite 807, 803 with 805, etc.), to match the heat being induced within them, without all of them being identical. This would ensure the heat induced on the fluid within pair 802-807 is not necessarily identical to that in the pair 803-805. Similarly, the rate of rotation may be similarly accelerated or slowed down (via separate mechanical means) to generate some of the same pairing temperature difference.

In another embodiment, the fluid being passed through certain orbital tubes may not be identical. In that form, one or more orbital tubes may be dedicated to generating air heating (for a forced air system), while others are dedicated to heating water for a water heater.

Figure 9:
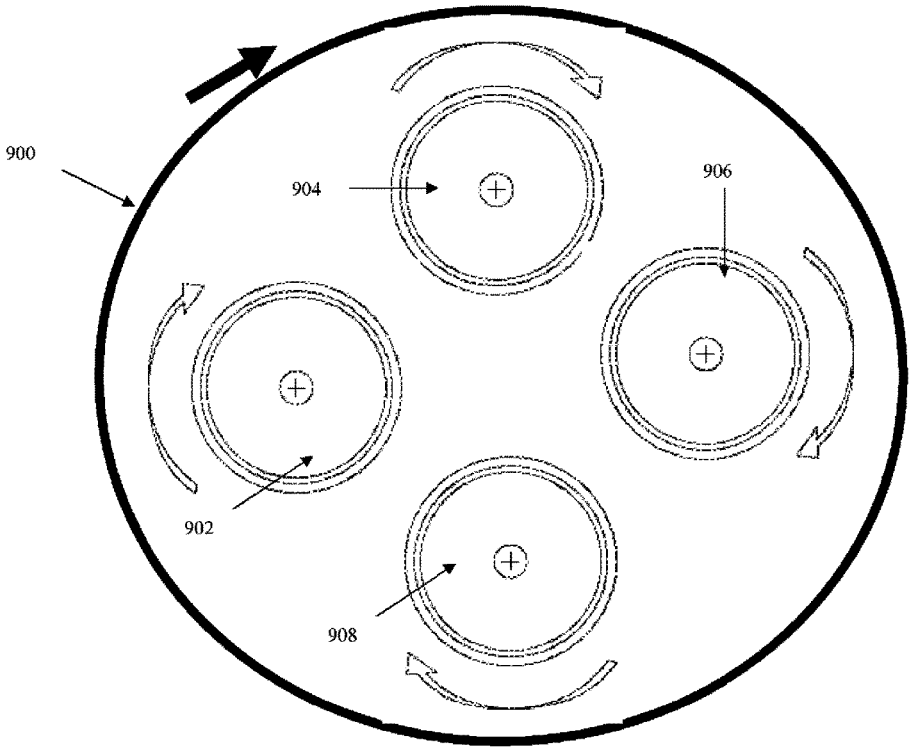

Note that the permanent magnet rotating unit need not be only in the inside. In the exemplary embodiment shown in FIG. 9, the element containing the alternating polarity permanent magnets 900 is placed as an rotating ring outside the one or more orbital elements 902, 904, 906, 908. In one embodiment, the orbital elements are stationary, while in an alternate embodiment, they are rotating. This rotation may be self-induced, or mechanically/electrically produced to match that of the outer ring.

The orbital rings may be of construction similar to that of those illustrated in FIG. 7 or FIG. 8, that is, as a sandwich of ferrous materials within non-ferrous materials, or vice-versa, with the ferrous material on the outside. As before the rotations may match, or be counter (assisted via mechanical/electrical means).

Figure 10:
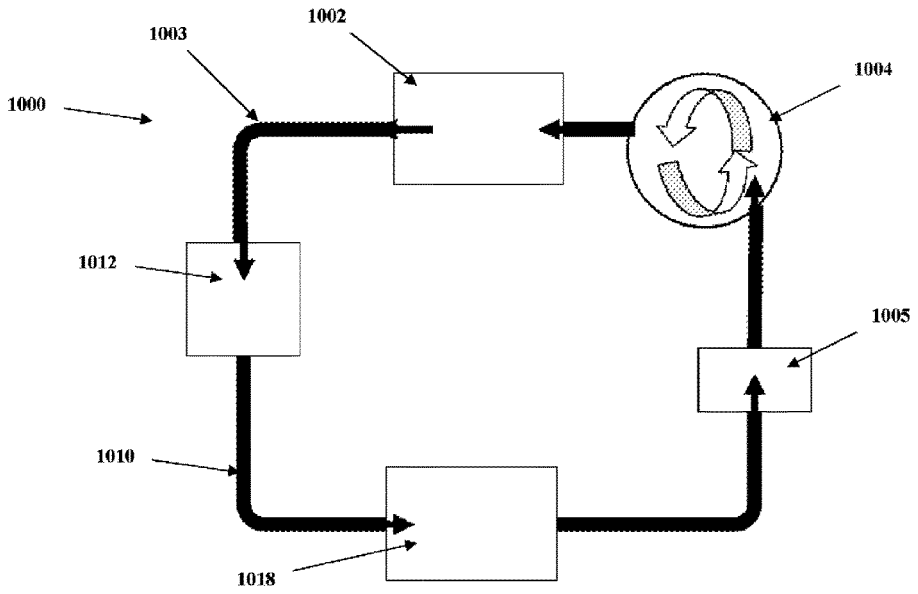
FIGS. 10, 11 and 13 show illustrations of the drying system with optional hydrogen/oxygen separation units, according to an exemplary embodiment of the invention.

The present invention, referring to FIG. 10, is a system 1000 for removing moisture from a material, said system having optional components for generating hydrogen (and oxygen), through the separation of water molecules ($H_2O$) into its two components. In general, the system operates by making a gas containing a variable amount of moisture travel though a series of chambers containing via pneumatically connected tubes, channels or conduits 1003.

In one embodiment, the gas being used is air, in an alternate embodiment, it may be a pure gas, including hydrogen or oxygen, or any mix of any other gas, preferably one heavier than oxygen to facilitate the separation of oxygen and the hydrogen.

When used primarily as a drier of a material in chamber 1018, the conduits 1003 are preferably made with connections that will facilitate the escape of separated hydrogen molecules in the first section following the magnetic field generator chamber 1002. The air is moved around the assembly 1000 via gas moving means apparatus, preferably a blower or fan assembly 1004. This moves the gas through the system components, including into the magnetic field generator chamber 1002. In an alternate embodiment, a humidifier is placed on chamber 1018 in order to provide the water molecules to be separated by the magnetic field generator 1002.

The optional heating chamber 1005 may be solar powered, or through the burning of carbon matter (coal, wood, oil, natural gas), or electrically heated. In an alternate embodiment, the hydrogen generated by the optional atomic separator 1012 may be fed into a burner to generate heat for the heating chamber 1005.

When a moisture laden gas mixture (preferably air, but other embodiments may utilize any particular gas) is subjected to a magnetic field generated by a magnetic field generator 1002, all or some of the water molecules break up into their individual Hydrogen and Oxygen components. In one embodiment, this breakup causes the humidity in the gas to be reduced, and when the hydrogen is allowed to escape, a resulting drying effect occurs. For cases where only drying is desired, the escape of hydrogen atoms following the magnetic field 1002 produces a significantly dryer gas, which may then be recycled to restart the drying process of the material placed on chamber 1018.

This split is partly due to mass differences, and partly due to a combination of the Zeeman and Paschen-Back effects on the actual atoms. As a result, for a period of time, there is a temporal separation between the oxygen and hydrogen atoms. At this point in the process, any of a variety of atomic separators may be used. In an alternate embodiment, the optional separation of the hydrogen (or the oxygen) may be accomplished in one embodiment by moving the gas containing the separated water molecules through a separator 1012.

In one embodiment, the system operates in a closed loop mode, where air is taken into the system. In an alternate embodiment, it is a closed loop. The closed loop system is preferred, as it would minimize contamination to the other system components.

Whether recirculated or fresh, the gas being fed into the magnetic field generator 1002 must be at an appropriate humidity. In one embodiment, a humidifier is placed within chamber 1018 and used to provide water from a reservoir of water. In an alternate embodiment, the humidification takes place via an ultrasonic transducer. In another embodiment, a sprayer is used. Yet another embodiment may us the wicking effect on a suitable surface across which the gas is forced. Note that the water being provided to the humidifying chamber may be optionally purified or filtered, in order to minimize the deposition of any particles at either the magnetic field generator 1002, the optional heating chamber 1005 or the atomic separator 1012.

In an alternate embodiment, the moisture supply may be any obtained by passing the dried gas stream 1010 (optimally that in the section after the magnetic field 1002 and/or optional hydrogen collector 1012 through any material in need of desiccation. These materials may include harvested fruits or beans (e.g. coffee, cacao), tea leaves and woods; as well as house or industrial laundry, etc. By placing or passing the material to be desiccated in a chamber 1018 through which the dried gas stream travels, the natural occurring moisture taken from the material to be dried could be used to supply the moisture that generates the hydrogen/oxygen.

Of particular importance in drying, has been the ability of the Berdut magnetic field generator of raising the temperature of air from the 25-30° C. range (typical air temperature for coffee growing regions), to the range of 60-70° C., which is optimal for coffee/cacao beans, as its allow their drying without "cooking" them. In addition to water in the chamber 1018, natural products such as these bring natural occurring sugars and alcohols, which are aided in the drying of the product by combining with any moisture.

The magnetic field generator 1002 being used by the system may be one of many embodiments. In one, it an electromagnet, such as those used in large electric motors and/or electricity generator sources (such as those in power plants). In effect, the area around the generator's armature would be sealed, and made part of the airflow. In the case of generation, the amount of humidity would be critical, as some of the equipment may deteriorate if exposed to too high a level. In any case, the design and/or retrofitting of existing units would allow for the generation of hydrogen/oxygen as an easy by-product of the generation of electricity. The hydrogen/oxygen generated could then be fed to the boilers in the plant together or separately.

The above is suitable for generators of up to 300 MW (which typically use air cooling). While care must be exercised vis-à-vis the humidity being used, the careful introduction of low levels of humidity (below 30%) would still reduce any corrosion while allowing for the by-product generation of hydrogen/oxygen. In large plants utilizing hydrogen cooling (typically 300 MW to 450 MW), the system could provide a ready source of hydrogen.

Figure 11:
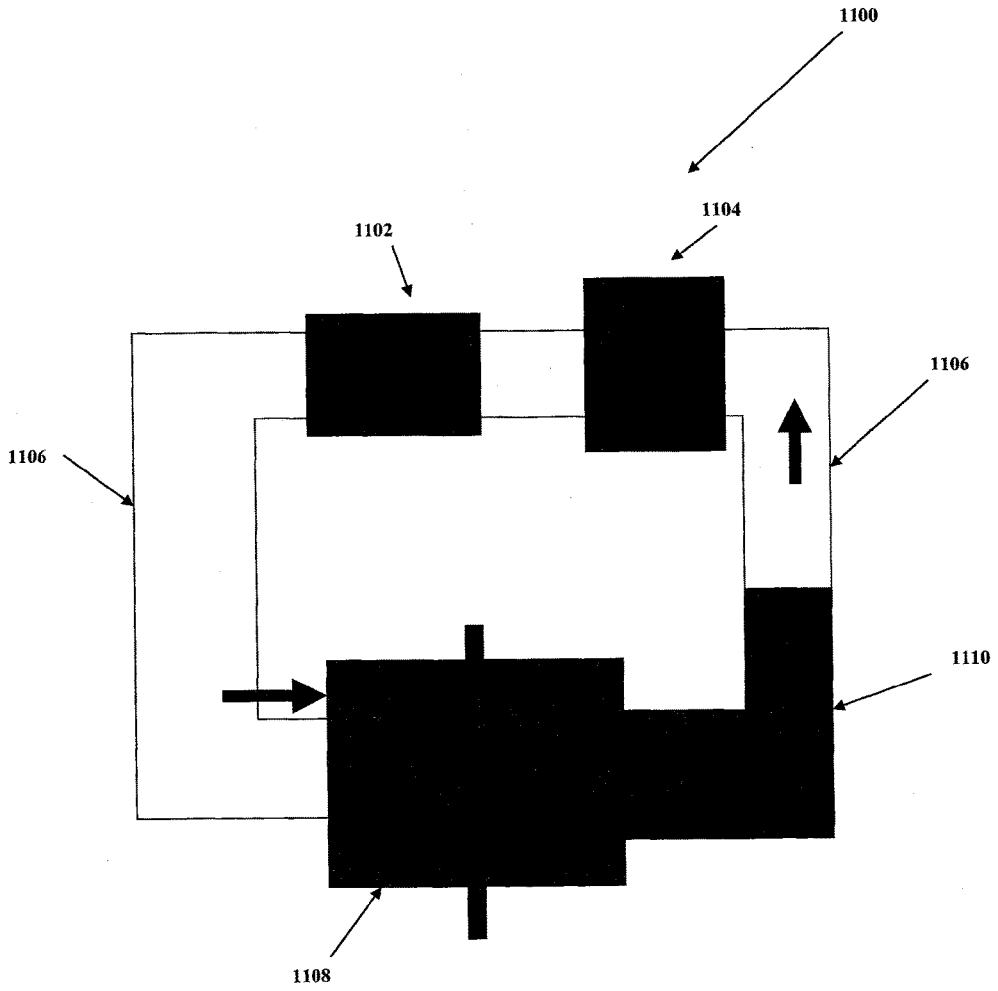

In an alternate embodiment FIG. 11, the system 1100 is a drying unit comprising an optional magnetic field and gasification unit 1102. In one embodiment, the heat generation unit is combined with the magnetic unit (as is the case when a Berdut permanent magnet rotation unit as described before is used). In an alternate embodiment, a separate heater or oven 1104 us placed upstream (airflow goes from fan, blower or such other air moving means 210 towards the heater 1104 and magnetic field generator 1102), in such cases either no magnetic gasification unit 1102 is used.

The gas or air conduits 1106 interconnect the unit's cavities (1102, 1104, 1108). The drying chamber 1108 is in one embodiment (FIGS. 14-15) a tumbler assembly 1400 (to facilitate the rotation of the product). Hydrogen and/or Oxygen is allowed to escape after the magnetic unit 1102 via either naturally occurring leaks or a bypass valve built into the magnetic unit 1102. In one embodiment, this is a valve that allows for the gas to escape on one side of the conduit while allowing air to come in through another, say with a venturi effect opening. A similar opening could be placed before and after the blower.

Again, referring to FIGS. 7-9, the magnetic field generator being used to generate the magnetic field is a Berdut permanent magnet magnetic field generator, as described in Berdut-Teruel (US Pat. Pub. No. 2011/0272398) and Berdut-Teruel (US Pat. Pub. No. 2011/0272399), the entire disclosure of which is herein incorporated by reference. The use of these Berdut magnetic field generators has the advantage of generating a small amount of heat which may replace that of the optional heating system 1005.

In one embodiment, such a magnetic field generator 700 is illustrated in FIG. 7. A permanent magnet first cylinder 702 containing a series of alternating permanent magnets mounted at or near the surface forming its periphery (N-pol 710, S-pol 712) is rotated around its longitudinal axis (defined by the line formed by the center of said cylinder bases). A counterclockwise direction is shown, but either direction may be used, to accomplish the desired magnetic flux variation. In an alternate embodiment, phenolic material may be interspersed with between the N-pol, S-pol magnets.

The one or more orbital cylinders 704, 705, 707, 709 made of a combination ferrous 708 and/or non-ferrous 706 materials are located with their longitudinal axis (around which they are rotating) in a significant parallel arrangement to the first cylinder. In one embodiment (704), the inner layer of the cylinder is made of ferrous materials 708, and the outer layer or skin is made of non-ferrous materials 706. While in one embodiment, all cylinders are made like this, in an alternate embodiment, the order is reversed, with the non-ferrous material being on the outside. In one embodiment, the moisture laden gas is passed through the inside of the orbital cylinders 704, 705, 707, 709. In an alternate embodiment, this inner volume is used to generate hot gases, whereas the moisture laden gas is passed through the outside.

In one embodiment, the orbital cylinders are made to rotate in the opposite direction (Clockwise (CK) if the first is going Counter-Clockwise (CCK), CCK if the first is going (CK)). In yet another embodiment, they are going in the same direction as the inner or central cylinder (CK to CK, CCK to CCK). Rotation of the inner and orbital cylinders may come from the same mechanical means (motor, gears, etc.), or from separate means. In one embodiment, one or more of the orbital cylinders may be made to rotate, and the contact between either the central or even one or more of the orbital cylinders is used to rotate it.

In a similar multi-orbiting cylinder embodiment, seen in an illustrative exemplary embodiment in FIG. 8, another embodiment of the magnetic field generator is 800 is illustrated. Orbital tubes or pipes (802, 803, 805, 807 and others) rotate around their longitudinal axis and surround a rotating permanent magnet assembly cylinder 804, whose magnetic surfaces are made of alternating N-pol (806, 814, etc.), S-Pol (808, 810, etc.) permanent magnets and optionally interposed phenolic 812 or other magnetic neutral materials. Said phenolic material may be used in other embodiments, as a way to save on magnetic material yet build appropriate structures. The complete assembly may be housed within a pneumatically sealed duct 820 suitable to keep the moisture laden air coming from the blower/fan 1004 flowing.

In one embodiment, the orbital pipes (802, 803, 805, 807 and others) are metal, or metal lined (be they ferrous or non-ferrous metals). In one embodiment, as with the exemplary embodiment shown in FIG. 7, the outside of the orbital tube is comprised of a ferrous metal, while the inside is lined of a non-ferrous metal. In an alternate embodiment, it is the reverse, with the non-ferrous material being on the outside. The non-ferrous material may be a metal like aluminum or copper, or it may also be a phenolic material like polymers (plastics), wood, or others.

In an alternate embodiment, the orbital pipes are made of a non-metallic material (for example PVC), but contain either an internal metallic lining, an internal hollow tube of lesser diameter made of metal, or simply a solid metal rod. In an alternate embodiment, the metal rod within the non-metallic tube is itself encased in a plastic shell or sheathing, to minimize interaction with the fluid travelling within it. The magnetic flux hears the metallic portion, which proceeds to heat the fluid within (be it water, air or oil).

As in FIG. 7, the orbital pipes or tubes in FIG. 8 may be designed so that one or more of them rotate along the central or longitudinal orbital axis of each pipe. Each elongated heating element would be capable of rotating along its individual longitudinal axis, with each said longitudinal axis being significantly parallel and offset from the longitudinal axis of the magnetic cylinder, and each said elongated heating element having at least one metal portion placed within the magnetic field generated by either the north or south polarity magnets mounted within said magnetic cylinder. This allows for a reduction in magnetic field losses (and hence higher system efficiency).

The orbital tube rotation may be mechanically induced (through friction with the internal rotating cylinder 804), or through other mechanical means such as belts connected to other motors, or the motor generating the rotation of the central cylinder 804. The moisture laden air may be routed through all or part of the enclosure 820 and/or the orbital pipes (802, 803, 805, 807 and others).

The disclosure of the aforementioned Wachsman et al. U.S. Pat. No. 6,235,417 patent is herein incorporated in its entirety. In Wachsman et al, a two-phase conductors are shown which are useful in the present invention and in which a metal such as palladium is used as an independent phase in the conductor. However, in addition to palladium and its alloys, other metals which may be used in this invention include Pt, Fe, Co, Cr, Mn, V, Nb, Zr, Ta, V, Ni, Au, Cu, Rh, and Ru.

The hydrogen conducting membrane may also include an oxide of the $ABO_3$ formula wherein A is selected from the group consisting of Ba, Ca, Mg and Sr (generally the alkaline earth metals) and B is $Ce_{1-x}M_x$ or $Zr_{1-x}M_x$ or $Sn_{1-x}M_x$, where x is greater than zero and less than one and M is selected from Ca, Y, Yb, In, Gd, Nd, Eu, Sm, Sr, Mg and Tb. As disclosed in patent application Ser. No. 09/192,115, filed Nov. 13, 1998 entitled Proton-Conducting Membrane Comprising Ceramic, A Method For Separating Hydrogen Using Ceramic Membranes, the entire disclosure of which is herein incorporated by reference.

Mixed oxides of the type disclosed therein in which the oxide is of the general formula $ABO_3$ wherein A is selected from the group consisting of Ba, Ca, Mg and Sr and B is selected from Ce, or Zr, or Sn, which may or may not be doped wherein the dopant is selected from Ca, y, Yb, In, Nd, Gd, Sr and Mg or combinations thereof are also useful in the present invention. Moreover, the catalytic metal in the above-disclosed mixed oxides may be selected from Pt, Pd, Fe, Co, Cr, Mn, V, Nb, Zr, Y, Ni, Au, Cu, Rh, Ru, their alloys and mixtures thereof. These membranes are useful for selectively transmitting protons, wherein the membrane has a thickness of between about 0.025 and about 5 millimeters.

In addition to membranes which transmit protons, as illustrated in the aforementioned '417 patent and the aforementioned '115 application, membranes made of certain metals will selectively transport atomic hydrogen. These are single phase membranes and include membranes of Pd, Nb, V, Ta, Zr, their alloys and mixtures thereof. Metals such as those above noted may be supported or unsupported. When supported, the membranes may be supported by an oxide or another metal, for instance, alumina as well as yttria stabilized zirconia or $SiO_2$ may be used as oxide ceramics to support the above-mentioned metals. In alternate embodiments, other metals may be used as supports for the above-identified metals, for instance, Cu may be used as a support metal for Nb.

Other methods and systems for this separation include those proposed by Kongmark et al (U.S. Pat. No. 7,935,254) or Lee et al (2004/0050801) may be used. In one embodiment, an additional heating element may be present in the portion of the system before its introduction to the membrane atomic separator 1012 to facilitate its operation. In all cases, the passing of the humid gas through the magnetic field aids substantially in the separation of the hydrogen/oxygen in the water molecules.

Figure 12:
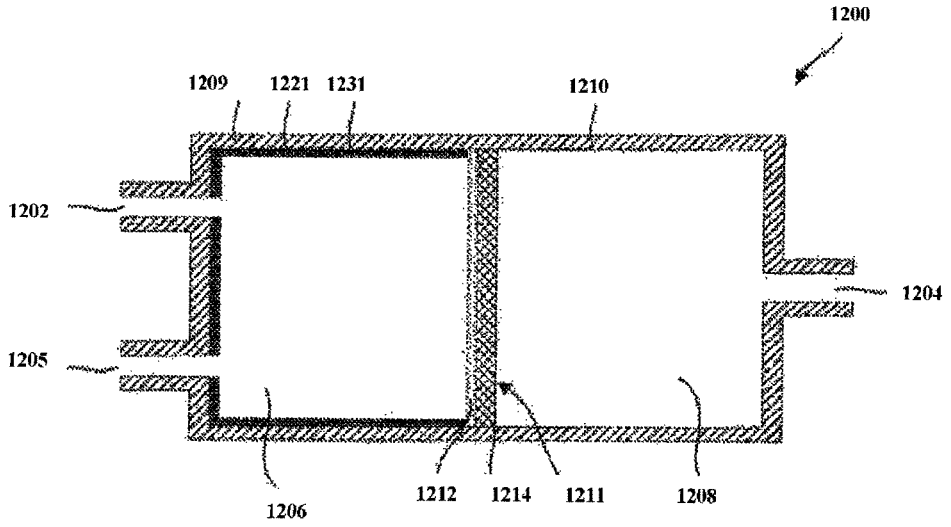
Prior Art Figure 12
FIG. 12 shows a membrane oxygen separator, according to the prior art.

Referring to FIG. 12, we see an exemplary embodiment of a prior art hydrogen separator for use as part of the present invention. A hydrogen separator includes a vessel 1200 that has a raw material inlet 1202, a hydrogen outlet 1204, a residual raw material outlet 1205, and an air/fluid passage 1206 that connects the raw material inlet 1203 to the hydrogen outlet 1204 and the residual raw material outlet 1205 and a selective hydrogen permeation section 1211 provided in the fluid passage 1206. The selective hydrogen permeation section 1211 includes a selective hydrogen permeable metal membrane 1212, and is provided in the fluid passage 1206 that is connected to the raw material inlet 1203 and the residual raw material outlet 1205 and a second passage 1208 that is connected to the hydrogen outlet 1204.

The selective hydrogen permeable metal membrane 1212 of the selective hydrogen permeation section 1211 selectively allows hydrogen contained in the raw material fluid or its product that flows through the first passage to pass through so that hydrogen enters the second passage 1208, with member 1210 and is discharged through the hydrogen outlet 1204. Furthermore, the hydrogen separator 1 according to the present invention is characterized in that an iron-containing metal surface 1221 that is exposed in the first passage and forms each of a member 1209 that forms the first passage and a member disposed in the first passage is covered with an iron component scattering prevention film 1231 at least in an area positioned on the upstream side with respect to the downstream end of a permeable section of the selective hydrogen permeable metal membrane 1212 in the flow direction of the fluid that flows through the first passage.

In one embodiment, the hydrogen and the oxygen are both collected, leaving the gas "carrier" in a state of humidity depletion. In an alternate embodiment, only the hydrogen is harvested/collected, leaving the oxygen rich gas mixture available for other functions, or to be recirculated. Alternatively, only the oxygen may be harvested. The harvested hydrogen is stored within a container 1014, wherein it may be transferred, compressed or otherwise handled.

Figure 13:
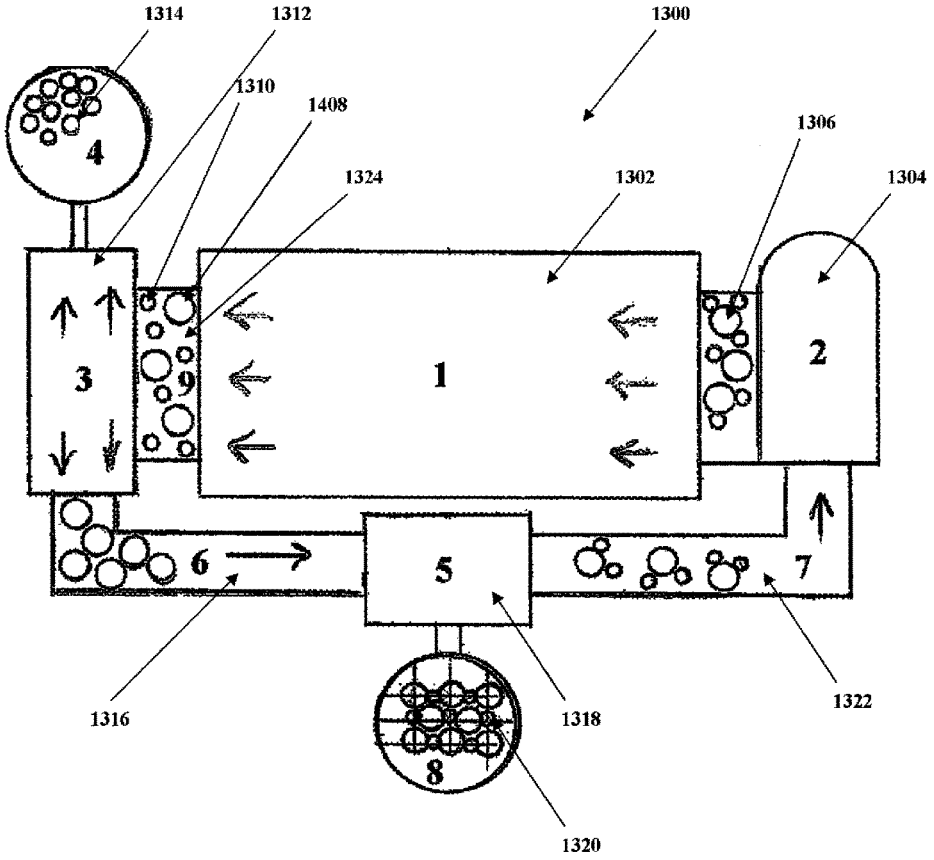

In an alternate embodiment FIG. 13 the system 1300 for the separation of the hydrogen (and/or oxygen) is accomplished having a sealed or semi-sealed gas containing enclosure capable of moving said mass of gas (by means of a blower, fan or other suitable gas moving means 1304) through a suitable magnetic field generator 1302, an oxygen 1308 and/or hydrogen 1310 separator 1312, then recirculating all or portion of a dried gas stream 1316 through a humidifier 1318 (connected to a suitable moisture supply 1320) back to the blower 1304 to repeat the cycle.

We have found that when a moisture laden gas mixture (preferably air, but other embodiments may utilize any particular gas) is subjected to a magnetic field generated by a magnetic field generator 1302, all or some of the water molecules 1306 break up into their individual Hydrogen 1310 and Oxygen 1308 components.

Figure 14:
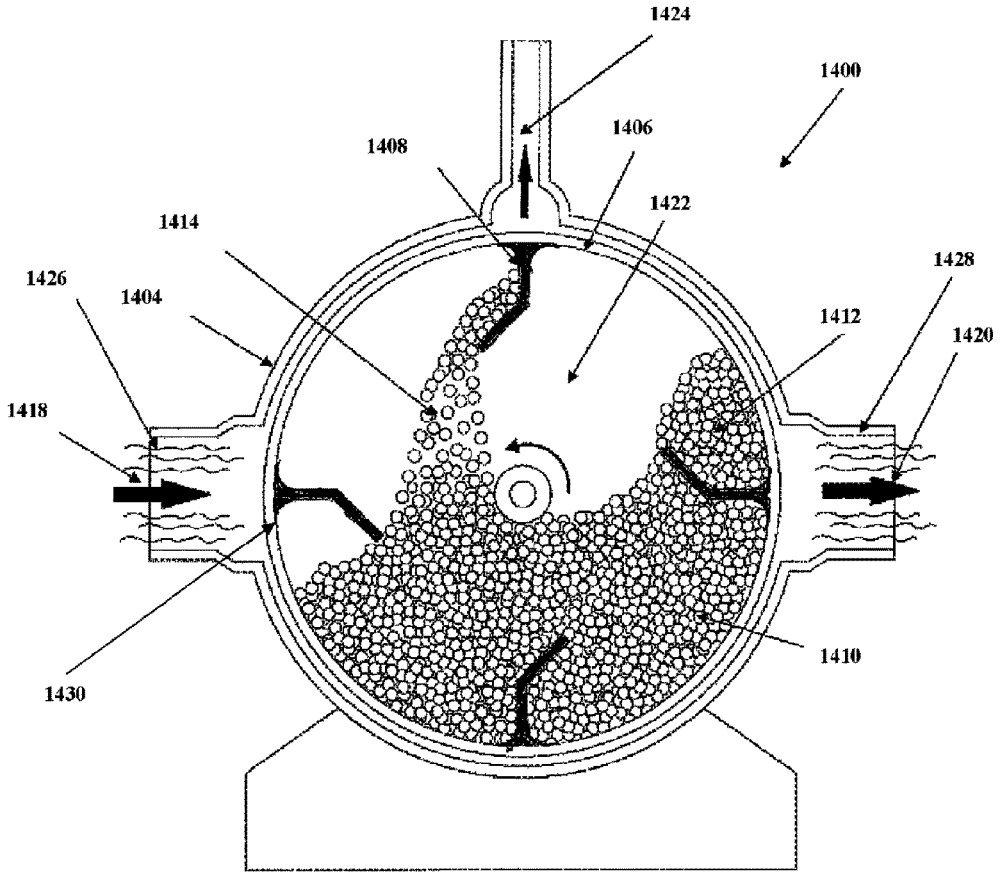
FIGS. 14-15 show a drying tumbler assembly system according to an exemplary embodiment of the invention.
Figure 15:
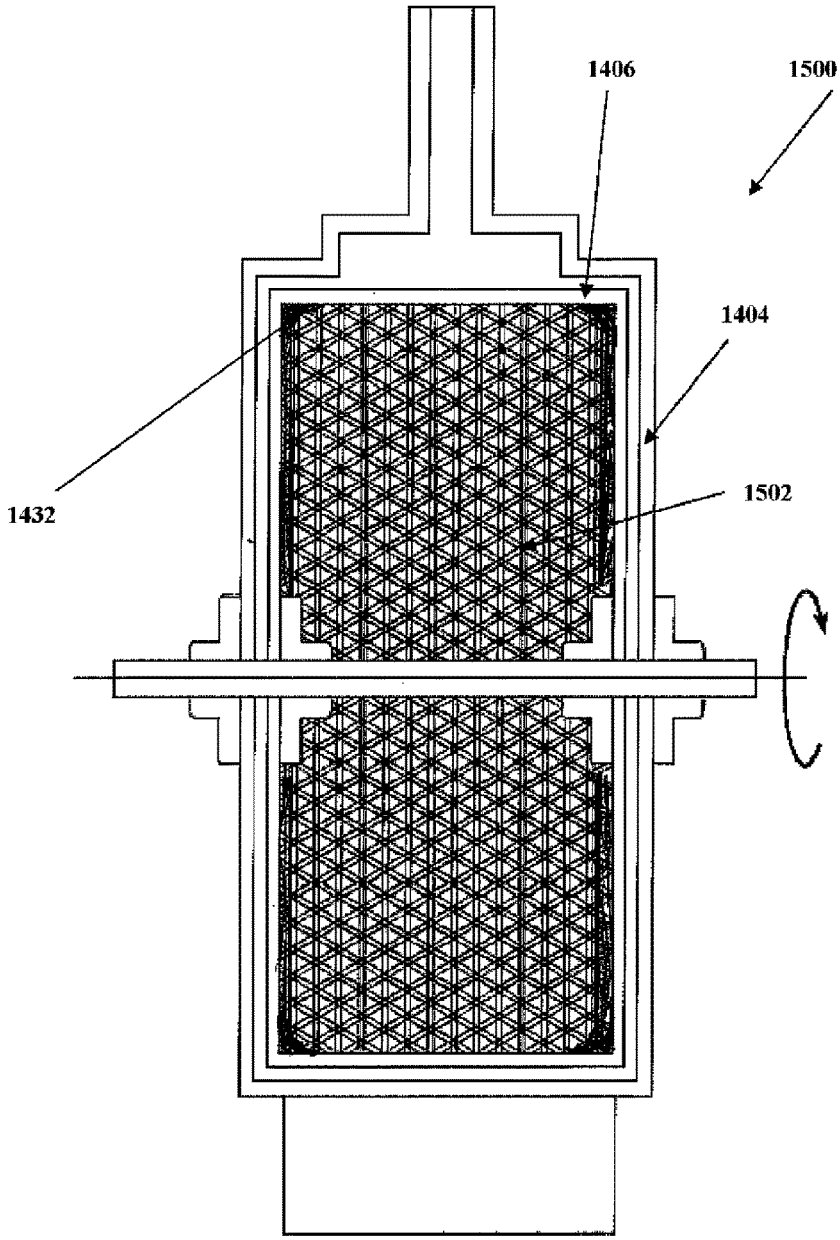

Referring to FIGS. 14-15, we see the revolving drying chamber or tumbler assembly from a side view 1400 as well as from a front view 1500. A solid wall insulated housing 1404 houses the rotating tumbler assembly 1406, creating a chamber 1422 for drying product. Within the tumbler chamber 1422 one or more mixing ribs, paddles or blades 1408 are provided with a scooping shape so as to elevate the product 1410 being dried. A critical element of the blade construction is the molded or blended base 1430. By avoiding right angles here as well as in any other juncture 1432, the product does not stick to these corners, avoiding burning or overcooking. The preferred embodiment is a constant radius curve.

In alternate embodiment, the angle of the blade or scoop may be made adjustable, so it may be optimized for the grain being dehydrated. In this fashion sufficient drying material is scooped and elevated 1412 to the upper portions of the tumbler to ensure the product then cascades 1414 past the airflow as it enters 1418 and exits 1420 the tumbler chamber. One or more walls of the tumbler are made to be porous, manufactured with a mesh material 1502 (be it metal, cloth or carbon composite) to allow for easy airflow past the product.

It is critical to point out that the drying material or product 1410 should not fill more than two thirds (⅔) of the chamber 1422. In one embodiment, the system is designed to be filled to approximately half (or less) of the tumbler volume, so that the external humidity or moisture in the product may be gasified quickly. This quick gasification of the external moisture is critical, else the product temperature may be raised too quickly by the hot air blowing through the tumbler. If not done, when drying the products such as coffee or cacao beans, there is a risk that you will 'cook' the beans, altering their flavor.

In the case of coffee, cacao and other similar grains, the husking process produces a humid bean surrounded by a sugar and starch membrane. This sticky membrane causes the clustering of the grains, which become hard to dry. They tend to stick onto any sharp corner, delaying the drying of the membranes not exposed to the airflow, which delays overall drying and may even cause the aforementioned 'cooking' of the grains.

In contrast, our system has a tumbler with rounded corners, polished surfaces, in combination with the product cascade limits or eliminates these clusters, producing a uniform drying action. This allows for the grains to be brought directly to the drying system without any pre-drying, saving time, energy and producing less contamination. In tests, the system has reduced the drying time from 24-48 hours to 4-6 hours, creating a uniform drying without compromising quality.

In one embodiment, one or more venting or exhaust openings are provided at the top of the chamber 1424 to allow for the measured escape of a portion of the airflow directly into the atmosphere. In one embodiment, this opening is one or more fixed size openings. As a rule of thumb, the diameter of these openings should be a percentage of that of the entry 1426 and exit 1428 airflow openings, with a range of less than 1% to even bigger than the exit airflow opening 1428, depending on how much of a closed loop system is desired. Since the air moving means (i.e. blower) could be located past exit opening 1428, a percentage of air from the chamber would always be captured.

In an alternate embodiment, a fixed or automated damper or valve could be installed in series with the opening 1424. Such a variable opening could be adjusted to the time of drying, the material being dried (coffee vs. cacao), the temperature of humidity measured in the airflow, etc. through either automatic means (valves and actuators) or signals to an operator. The lightweight construction of the tumbler assembly 1400 would allow for the system to be easily transportable.

CONCLUSION

In concluding the detailed description, it should be noted that it would be obvious to those skilled in the art that many variations and modifications can be made to the preferred embodiment without substantially departing from the principles of the present invention. Also, such variations and modifications are intended to be included herein within the scope of the present invention as set forth in the appended claims. Further, in the claims hereafter, the structures, materials, acts and equivalents of all means or step-plus function elements are intended to include any structure, materials or acts for performing their cited functions.

It should be emphasized that the above-described embodiments of the present invention, particularly any "preferred embodiments" are merely possible examples of the implementations, merely set forth for a clear understanding of the principles of the invention. Any variations and modifications may be made to the above-described embodiments of the invention without departing substantially from the spirit of the principles of the invention. All such modifications and variations are intended to be included herein within the scope of the disclosure and present invention and protected by the following claims.

The present invention has been described in sufficient detail with a certain degree of particularity. The utilities thereof are appreciated by those skilled in the art. It is understood to those skilled in the art that the present disclosure of embodiments has been made by way of examples only and that numerous changes in the arrangement and combination of parts may be resorted without departing from the spirit and scope of the invention as claimed. Accordingly, the scope of the present invention is defined by the appended claims rather than the forgoing description of embodiments.

The invention claimed is:

1. A product dehydrator system comprising;

a series of conduits connecting one or more chambers;

one or more said chambers containing gas heating means;

one or more said chambers containing gas moving means;

one or more said chambers containing product drying means, wherein said product drying means are comprised of a drying tumbler assembly comprised of solid wall insulated housing having within it a rotating tumbler made from a mesh material and having porous walls, said rotating tumbler having one or more angled blades having a scoop shape that avoids right angles at any point, each blade having a curved blended base with no sharp angles at the juncture of said blade to said rotating tumbler, forming a constant radius curve shaped base on both sides of said blade base so that each said blade lifts and drops portions of the product within to create a product cascade past an airflow stream going horizontally from an entry opening located on the side of said housing to an exit opening located on the opposite side in said tumbler assembly's solid walls, both said openings being connected to portions of the series of conduits, said solid walls also having one or more venting openings at its top, for venting of portions of said airflow out of the series of conduits and into the atmosphere;

said gas heating means are provided by the operation of a permanent magnet thermal generator apparatus comprising a magnetic cylinder rotatable about its concentric longitudinal axis whose magnetic surface is made of alternating N-pol and S-pol permanent magnets;

said magnetic cylinder magnetic surface has phenolic material interspersed between said N-pol and said S-pol permanent magnets;

one or more hollow orbital pipes, each said orbital pipe freely rotatable about its own concentric axis of rotation, wherein said axis of rotation is parallel to and offset from the longitudinal axis of said magnetic cylinder, each said orbital pipe having at least one metal portion directly exposable to a magnetic field to be generated by said N-pol and S-pol permanent magnets mounted within said magnetic cylinder when said magnetic cylinder is rotated so that any rotation of each said orbital pipe is due solely to the effect of the magnetic field induced on said orbital pipe by said magnetic cylinder rotation;

a mechanism for rotating said magnetic cylinder around its longitudinal axis, and said magnetic cylinder when so rotated induces independent rotation of each said one or more hollow pipes about its respective offset concentric longitudinal axis; and said gas moving means are comprised of a fan.

2. The system of claim 1 further comprising;

hydrogen separation means.

3. A product dehydrator system comprising;

a series of conduits connecting one or more chambers;

one or more said chambers containing gas heating means;

one or more said chambers containing gas moving means;

one or more said chambers containing product drying means, wherein said product drying means are comprised of a drying tumbler assembly comprised of solid wall insulated housing having within it a rotating tumbler made from a mesh material and having porous walls, said rotating tumbler having one or more angled blades having a scoop shape that avoids right angles at any point, each blade base having a curved blended base with no sharp angles at the juncture of said blade to said rotating tumbler, forming a constant radius curve shaped base on both sides of said blade base so that each said blade lifts and drops portions of the product within to create a product cascade past an airflow stream going horizontally from an entry opening located on the side of said housing to an exit opening located on the opposite side in said tumbler assembly's solid walls, both said openings being connected to portions of the series of conduits, said solid walls also having one or more venting openings at its top, for venting of portions of said airflow out of the series of conduits and into the atmosphere;

said gas heating means are provided by the operation of a permanent magnet thermal generator apparatus comprising a hollow magnetic cylinder rotatable about its concentric longitudinal axis whose magnetic surface is made of alternating N-pol and S-pol permanent magnets;

said magnetic cylinder magnetic surface has phenolic material interspersed between said N-pol and said S-pol permanent magnets;

one or more hollow orbital pipes located inside said hollow magnetic cylinder and having at least one metal portion directly exposable to a magnetic field to be generated by said N-pol and S-pol permanent magnets mounted on said hollow magnetic cylinder when said hollow magnetic cylinder is rotated, each said hollow orbital pipes is freely rotatable about its concentric axis of rotation, wherein said axis of rotation is parallel to and offset from the longitudinal axis of said magnetic cylinder, and located inside the inner surface of said hollow magnetic cylinder so that any rotation of each said orbital pipe is due solely to the effect of the magnetic field induced on said orbital pipe by said magnetic cylinder rotation;

a mechanism for rotating said magnetic cylinder around said magnetic cylinder's longitudinal axis and said magnetic cylinder when so rotated induces independent rotation of each said one or more hollow orbital pipes about its respective offset concentric longitudinal axis; and said gas moving means are comprised of a fan.

* * * * *